US008308250B2

(12) United States Patent
Koehler

(10) Patent No.: US 8,308,250 B2
(45) Date of Patent: Nov. 13, 2012

(54) RACK SYSTEM FOR AN APPLIANCE

(75) Inventor: Edwin Koehler, Nashville, TN (US)

(73) Assignee: Electrolux Home Products, Inc., Charlotte, NC (US)

( * ) Notice: Subject to any disclaimer, the term of this patent is extended or adjusted under 35 U.S.C. 154(b) by 103 days.

(21) Appl. No.: 12/463,631

(22) Filed: May 11, 2009

(65) Prior Publication Data

US 2010/0283364 A1 Nov. 11, 2010

(51) Int. Cl.
*A47B 81/00* (2006.01)
*A47B 95/00* (2006.01)
*F24C 15/16* (2006.01)

(52) U.S. Cl. ..... 312/274; 312/410; 312/325; 126/340; 126/333; 126/339

(58) Field of Classification Search ..... 312/271, 312/273, 274, 275, 276, 311, 306, 327, 408, 312/325, 319.2, 319.3, 410; 99/446; 126/191, 126/340, 339, 333, 337 R, 337 A; 108/44, 108/38; 248/220.21; 211/41.8, 41.9; 134/135
See application file for complete search history.

(56) References Cited

U.S. PATENT DOCUMENTS 1,244,440 A * 10/1917 Franklin et al. ..... 126/340
1,262,659 A 4/1918 Foster
1,456,474 A * 5/1923 Sussman ..... 126/37 B
1,487,950 A 3/1924 Kimmerle
1,582,543 A 4/1926 Rowden
1,776,475 A 9/1930 Moss
1,785,514 A * 12/1930 Chandler et al. ..... 126/340
1,819,388 A * 8/1931 Rosselle ..... 126/340
1,855,561 A * 4/1932 Ritthaler ..... 126/340
1,858,539 A * 5/1932 Dewey ..... 312/266
1,864,462 A 6/1932 Olsen
1,885,404 A * 11/1932 Bamberg et al. ..... 126/340
1,894,268 A * 1/1933 Roy et al. ..... 126/340
1,958,348 A * 5/1934 Raley ..... 126/340

(Continued)

FOREIGN PATENT DOCUMENTS

DE 8701330 10/1987

(Continued)

OTHER PUBLICATIONS

Translation of Japenese Patent No. 61186727, publication date on 20 Aug. 1986.*

(Continued)

*Primary Examiner* — Darnell Jayne
*Assistant Examiner* — Kimberley S Wright
(74) *Attorney, Agent, or Firm* — Pearne & Gordon LLP

(57) ABSTRACT

A rack system for an appliance is provided. The rack system includes a door link, a first coupler link, a first rack, a bracket, a second coupler link, and a second rack. The door link is attached to an appliance door. The first coupler link is attached to the door link and connected to the first rack. The bracket is attached to either the first rack or the second rack. The second coupler link is attached to the bracket at one of the sites for attachment and connected to whichever one of either the first or second racks to which the bracket is not attached. The linear movement of the first and second racks can be non-staggered or staggered depending on the attachment site of the bracket to which the second coupler link is attached.

18 Claims, 7 Drawing Sheets

U.S. PATENT DOCUMENTS

| | | | | | |
|---|---|---|---|---|---|
| 1,987,087 | A | * | 1/1935 | Underwood | 126/340 |
| 1,989,778 | A | * | 2/1935 | Wintz | 206/289 |
| 2,070,174 | A | * | 2/1937 | Pace | 312/237 |
| 2,133,425 | A | * | 10/1938 | Carlson | 248/694 |
| 2,222,201 | A | * | 11/1940 | Ito | 62/265 |
| 2,263,473 | A | * | 11/1941 | Rogers | 126/340 |
| 2,281,114 | A | * | 4/1942 | Schwab | 206/289 |
| 2,315,595 | A | * | 4/1943 | Chappory | 211/186 |
| 2,319,651 | A | * | 5/1943 | Wilkinson et al. | 126/340 |
| 2,296,950 | A | | 9/1949 | Roedl | |
| 2,525,201 | A | * | 10/1950 | Beynon et al. | 126/340 |
| 2,576,252 | A | * | 11/1951 | Conner | 126/340 |
| 2,886,394 | A | * | 5/1959 | Snyder | 312/276 |
| 2,943,497 | A | * | 7/1960 | Meisinger et al. | 74/106 |
| 2,979,054 | A | * | 4/1961 | Jenkins | 126/340 |
| 2,987,363 | A | | 6/1961 | Morse | |
| 2,997,041 | A | * | 8/1961 | Wolske | 126/191 |
| 3,024,344 | A | * | 3/1962 | Dills | 236/99 R |
| 3,074,734 | A | * | 1/1963 | Munson et al. | 280/641 |
| 3,106,202 | A | * | 10/1963 | Arduna | 126/340 |
| 3,152,536 | A | * | 10/1964 | Lucas | 99/397 |
| 3,194,610 | A | * | 7/1965 | Stewart | 384/19 |
| 3,195,969 | A | * | 7/1965 | Wallen | 312/269 |
| 3,321,261 | A | * | 5/1967 | Guth | 312/269 |
| 3,322,479 | A | * | 5/1967 | Pattison et al. | 312/269 |
| 3,390,930 | A | * | 7/1968 | Peterson | 312/269 |
| 3,667,714 | A | * | 6/1972 | Ziaylek | 248/284.1 |
| 3,744,646 | A | * | 7/1973 | Duncan et al. | 211/162 |
| 3,799,640 | A | * | 3/1974 | Jacobs | 312/273 |
| 3,830,220 | A | | 8/1974 | Demetreon | |
| 3,842,936 | A | * | 10/1974 | De Luca | 182/129 |
| 3,853,113 | A | * | 12/1974 | Burford | 126/41 E |
| 4,048,984 | A | * | 9/1977 | Eberhardt | 126/337 R |
| 4,144,869 | A | * | 3/1979 | Oatley | 126/19 M |
| 4,449,765 | A | * | 5/1984 | Lampman | 312/311 |
| 4,510,362 | A | * | 4/1985 | Miller | 219/732 |
| 4,637,373 | A | | 1/1987 | Shirai et al. | |
| 5,074,223 | A | * | 12/1991 | Remmers | 108/91 |
| 5,115,822 | A | * | 5/1992 | Nichols | 134/135 |
| 6,286,691 | B1 | * | 9/2001 | Oberhaus et al. | 211/118 |
| 7,173,217 | B2 | * | 2/2007 | De'Longhi | 219/392 |
| 7,703,453 | B2 | * | 4/2010 | Hughes | 126/339 |
| 2005/0001524 | A1 | * | 1/2005 | Deiss et al. | 312/334.4 |
| 2005/0217658 | A1 | | 10/2005 | Sozo et al. | |

FOREIGN PATENT DOCUMENTS

| | | |
|---|---|---|
| JP | 61186727 | 8/1986 |
| JP | 61291839 | 12/1986 |

OTHER PUBLICATIONS

International Search Report for International Application No. PCT/US/2010/032344 completed on Aug. 26, 2010, and mailed on Sep. 3, 2010.

* cited by examiner

RACK SYSTEM FOR AN APPLIANCE

RELATED APPLICATIONS

Not Applicable.

FIELD OF THE INVENTION

The present invention relates to racks for appliances, and more particularly, to a linkage system for automatically extending and retracting racks within an oven.

BACKGROUND OF THE INVENTION

Appliances, such as ovens, often have one or more racks generally within the appliance. For example, the racks can be useful for the placing of cookware, food, and other items, within the oven. The racks can support the cookware within the oven, and can keep the cookware away from heating elements and the like. In addition, ovens with multiple racks allow for placement of cookware on a variety of levels within the oven, thereby increasing the total volume of available cooking.

The racks are often supported by ledges formed along the inner walls of the oven. The racks are then movable in and out of the oven on the ledges. This allows the racks to be removed from the oven for cleaning or for other purposes. Often, the racks may be partially removed from the oven so as to allow easier access to items placed on the racks. The ledges also facilitate vertical adjustment of the racks within the oven cavity.

Various devices have been provided for automatically extending and retracting racks from an oven upon opening of the oven door. Typical problems associated with such devices are that the devices are overly complex and/or not easily assembled and disassembled.

BRIEF SUMMARY OF THE INVENTION

The following presents a simplified summary of the invention in order to provide a basic understanding of some aspects of the invention. This summary is not an extensive overview of the invention. It is not intended to identify either key or critical elements of the invention or to delineate the scope of the invention. Its sole purpose is to present some concepts of the invention in a simplified form as a prelude to the more detailed description that is presented later.

A rack system for an appliance is provided. The rack system includes a door link, a first coupler link, a first rack, a second coupler link, and a second rack. A bracket has a plurality of sites for attachment with the second coupler link. The door link is attached to an appliance door. The first coupler link is attached to the door link and connected to the first rack. The bracket is attached to either the first rack or the second rack. The second coupler link is attached to the bracket at one of the sites for attachment and connected to whichever one of either the first or second racks to which the bracket is not attached. The first rack is translationally coupled to the appliance door through the door link and the first coupler link and not through the bracket or the second coupler link. The second rack is translationally coupled to the first rack through the bracket and the second coupler link and not through the door link or the first coupler link.

An appliance is also provided. The appliance includes an appliance cavity, a plurality of appliance supports, an appliance door, a first rack, a second rack, a bracket, a door link, a first coupler link, and a second coupler link. The bracket has a plurality of apertures for attachment with the second coupler link. The plurality of appliance supports is located within the appliance cavity. The first rack is supported by one of the appliance supports for slidably extending from and retracting into the appliance cavity. The second rack is supported by another of the appliance supports for slidably extending from and retracting into the appliance cavity. The door link is attached to the appliance door. The first coupler link is attached to the door link and connected to the first rack. The bracket is attached to either the first rack or the second rack. The second coupler link is attached to the bracket at one of the apertures for attachment of the bracket and is connected to whichever one of either the first or second racks to which the bracket is not attached. The first rack is translationally coupled to the appliance door through the door link and the first coupler link and not through the bracket or the second coupler link. The second rack is translationally coupled to the first rack through the bracket and the second coupler link and not through the door link or the first coupler link.

BRIEF DESCRIPTION OF THE DRAWINGS

The foregoing and other features and advantages of the present invention will become apparent to those skilled in the art to which the present invention relates upon reading the following description with reference to the accompanying drawings, in which.

DESCRIPTION OF AN EXAMPLE EMBODIMENT

Figure 1:
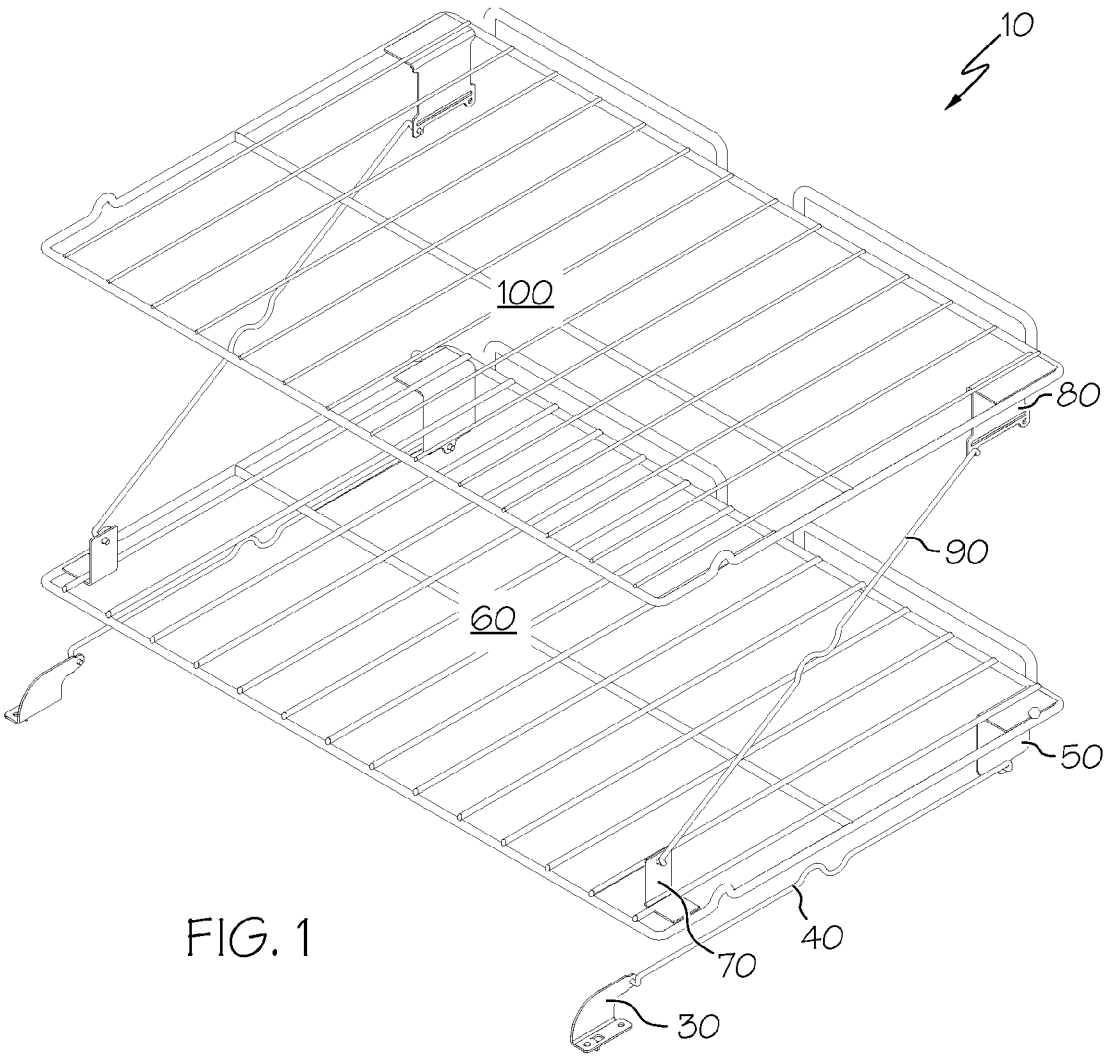
FIG. 1 illustrates a perspective view of an example rack system in accordance with an embodiment of the present invention.

An example embodiment of a rack system that incorporates aspects of the present invention is shown in the drawings. It is to be appreciated that the shown example is not intended to be a limitation on the present invention. For example, one or more aspects of the present invention can be utilized in other embodiments and even other types of rack systems.

Attachment is herein defined as a linkage between two objects based on direct contact between the two objects. Connection is herein defined as a linkage between two objects that can be based on direct contact or indirect contact between the two objects. Detachable attachment is herein defined as an attachment that can be made and unmade manually, without requiring use of a tool. Likewise, detachable connection is herein defined as a connection that can be made and unmade manually, without requiring use of a tool.

Figure 2:
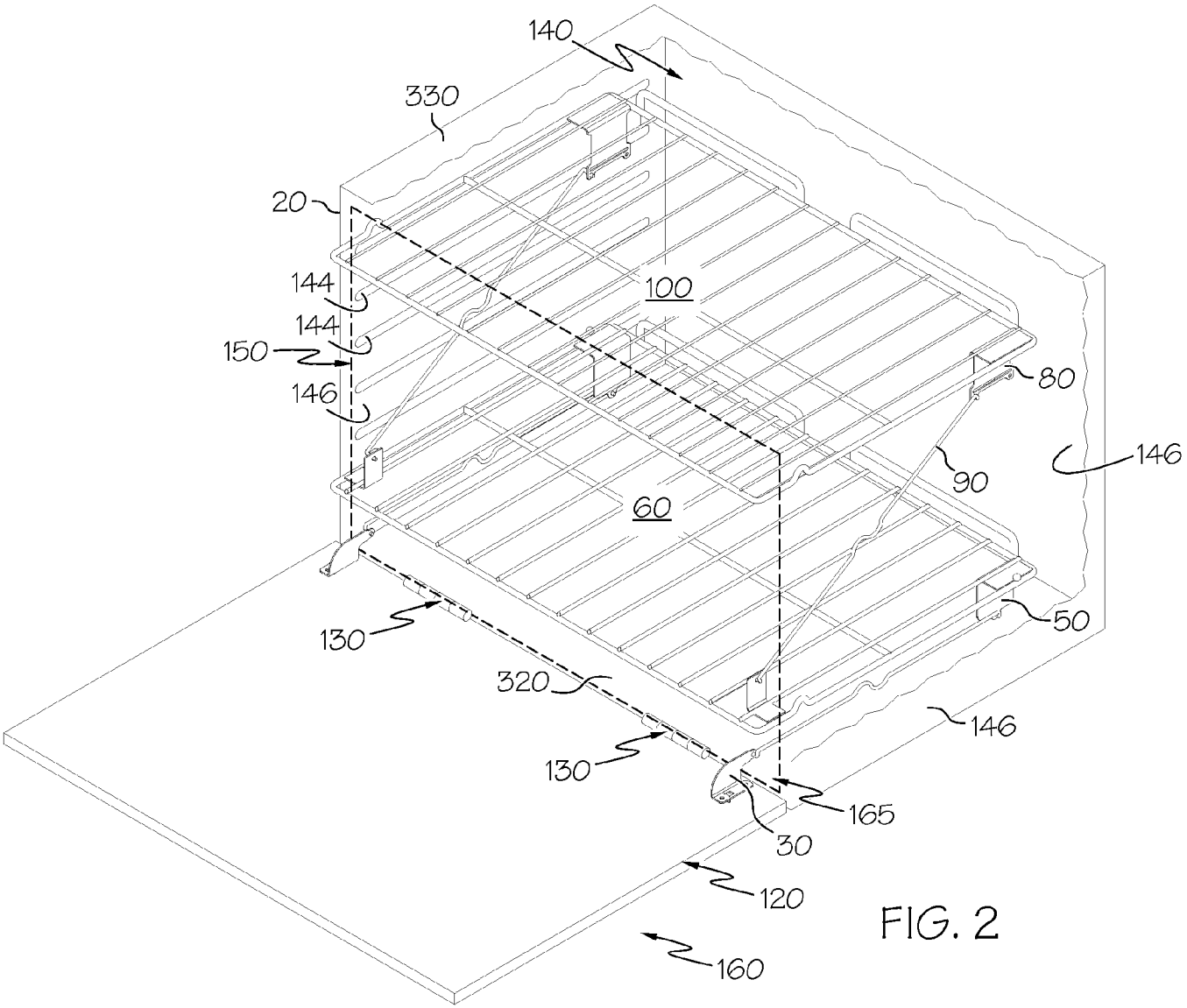
FIG. 2 illustrates a perspective view of an example appliance including a rack system in accordance with an embodiment of the present invention.

Turning to the shown example of FIGS. 1 and 2, an example of a rack system 10 for an appliance 20, such as an oven, is illustrated in accordance with one embodiment. As shown in FIG. 1, the rack system 10 includes a door link 30, a first coupler link 40, a first connector 50, a first rack 60, a second connector 70, a bracket 80, a second coupler link 90, and a second rack 100. The door link 30, first coupler link 40, first connector 50, first rack 60, second connector 70, bracket 80, second coupler link 90, and second rack 100 can be constructed from materials able to withstand high oven operating temperatures. Materials suitable for such purposes can include uncoated or coated metal, such as iron coated with nickel, steel coated with porcelain, or metal coated with a high temperature performance coating. Depending upon its application, various other materials are also suitable and will be known to a person having ordinary skill in the art.

As shown in FIG. 2, the appliance 20 has an appliance front end 110 corresponding to a cavity 140, which is closed by an appliance door 120 via door hinges (not shown). The cavity 140 includes appliance ledges 144 positioned on side walls 146 of the cavity 140. The appliance door 120 is attached to the appliance 20 via the door hinges. The appliance door 120 can be maintained in a fully closed position 150, a fully open position 160, or any intermediate position, relative to the appliance 20, based on the position of the door hinges. The appliance ledges 144 are attached to, or intrinsic to, the appliance side walls 146 and provide support for the first rack 60 and the second rack 100.

The appliance door 120 has an inner door surface 165 that faces inward toward the appliance cavity 140 when the appliance door is in a fully closed position 150.

Figure 3:
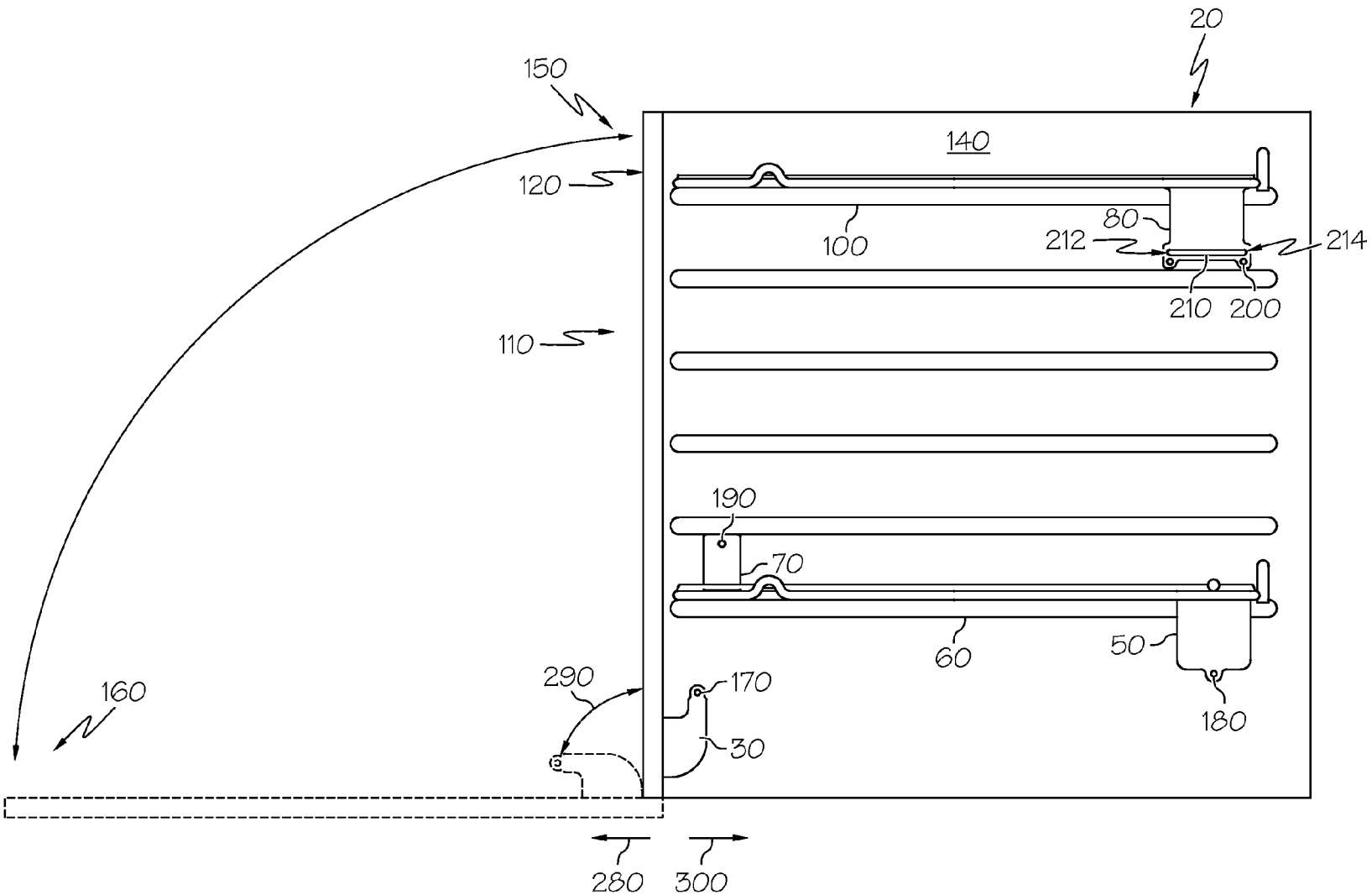
FIG. 3 illustrates a side view of the example appliance of FIG. 2 lacking the coupler links, in which the racks therein are fully retracted and in which the door is opened from a fully closed position to a fully opened position.

Turning now to FIG. 3, the door link 30 has an attachment site 170, for example a round aperture. The first connector 50 has an attachment site 180, for example also a round aperture. The second connector 70 has an attachment site 190, for example also a round aperture. It is to be appreciated that attachment sites 170, 180, and 190 are not limited to round apertures, but rather each may alternatively and independently be a slot, a gap, a groove, an indentation, or the like.

The bracket 80 has a first attachment site 200, for example a round aperture, and a second attachment site 210, for example an elongated aperture. It is to be appreciated that first attachment site 200 is not limited to a round aperture, but alternatively may be a slot, a gap, a groove, an indentation, or the like. It is also to be appreciated that second attachment site 210 is not limited to an elongated aperture, but may correspond to an elongated slot, an elongated gap, an elongated groove, an elongated indentation, or the like. In accordance with one embodiment, the second attachment site 210 has a front end 212 and a back end 214, the front end 212 and back end 214 being located proximal and distal, respectively, to appliance front end 110. In accordance with this embodiment, when first rack 60 and second rack 100 are entirely contained within appliance 20, front end 212 is closer to appliance front end 110 than is any part of first attachment site 200.

Figure 4:
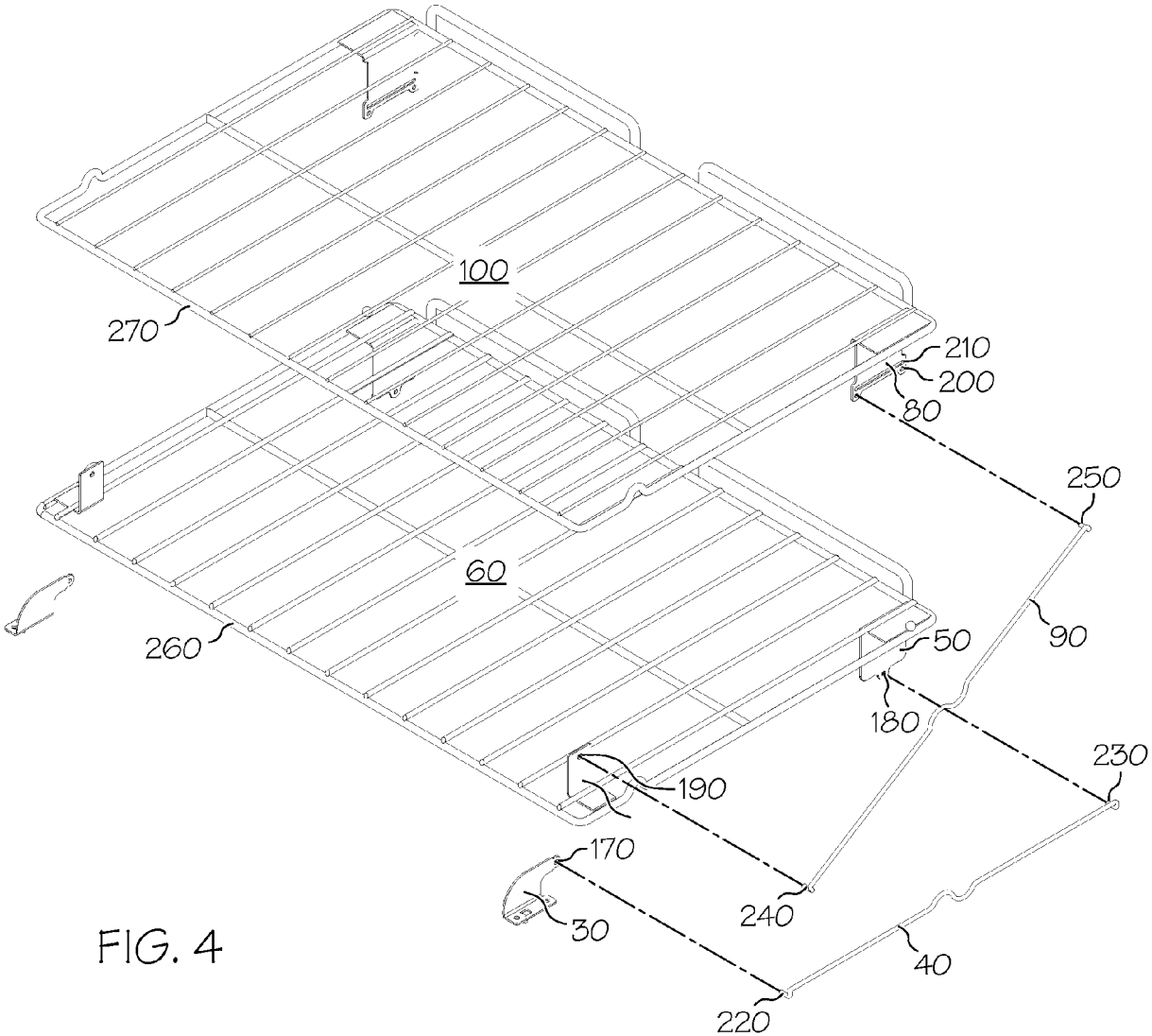
FIG. 4 illustrates a perspective view of the example rack system of FIG. 1 in which coupler links are being attached.

Turning now to FIG. 4, the first coupler link 40 has a first end 220 and a second end 230. Likewise, the second coupler link 90 has a first end 240 and a second end 250. First rack 60 has a front end 260. Second rack 100 has a front end 270.

The various components of the rack system 10 are attached and/or connected as follows. Returning to FIG. 2, the door link 30 is attached to the appliance door 120, for example on inner door surface 165. Returning to FIG. 4, the first coupler link 40 is attached, for example detachably, to the door link 30, for example by placing the first end 220 of the first coupler link 40 through the attachment site 170 of the door link 30. The first coupler link 40 is also connected, for example detachably, to the first rack 60. The connection can be made, for example, by attaching, for example detachably, the second end 230 of the first coupler link 40 to the first connector 50, for example by placing the second end 230 of the first coupler link through the attachment site 190 of the first connector 50. The second coupler link 90 is connected, for example detachably, to the first rack 60. The connection can be made, for example, by attaching, for example detachably, the first end 240 of the second coupler link 90 to the second connector 70, for example by placing the first end 240 of the second coupler link 90 through the attachment site 190 of the second connector 70. The second coupler link 90 is also connected to the second rack 100 via the bracket 80, this connection being described in greater detail below.

The rack system 10 can translationally couple the appliance door 120 to the first rack 60 and second rack 100 as follows. Returning to FIG. 3, in accordance with this embodiment, opening the appliance door 120 from the fully closed position 150 to the fully opened position 160 causes the door link 30 to move in a forward direction 280, along an arc 290, from inside the appliance cavity 140, across the appliance front end 110, to a position outside and forward of appliance 20. Considering FIGS. 3, 5, and 6 together, this forward movement of door link 30 in a forward direction 280 causes first coupler link 40, first connector 50, and first rack 60 to move forward also in forward direction 280, based on the various attachments and connections described above. Then, depending upon the connections, the forward movement of first rack 60 can cause second connector 70, second coupler link 90, bracket 80, and second rack 100 to move forward also, again based on the various attachments and connections described above. In this example, the result is that the front end 260 of first rack 60 and the front end 270 of second rack 100 move from inside appliance cavity 140, across appliance front end 110, to a position outside and forward of appliance 20, such that first rack 60 and second rack 100 extend, for example at least partially, from appliance cavity 140.

Further in accordance with this embodiment, closing the appliance door 120 from the fully opened position 160 to the fully closed position 150 causes door link 30, first coupler link 40, first connector 50, first rack 60, second connector 70, second coupler link 90, bracket 80, and second rack 100 to move backward in backward direction 300, toward and further into the appliance cavity 140, again based on the various attachments and connections described above. The result is that the first rack front end 260 and the second rack front end 270 move from a position outside of and forward of appliance 20, across appliance front end 110, and into appliance cavity 140, such that first rack 60 and second rack 100 retract fully into appliance cavity 140.

Further still in accordance with this embodiment, partially opening appliance door 120 will cause forward movement of door link 30, first coupler link 40, first connector 50, first rack 60, second connector 70, second coupler link 90, as described above, and potentially may also cause forward movement of bracket 80 and second rack 100, as described in more detail below. Likewise, partially closing appliance door 120 will cause backward movement of door link 30, first coupler link 40, first connector 50, first rack 60, second connector 70, second coupler link 90, as described above, and potentially may also cause backward movement of bracket 80 and second rack 100, as described in more detail below.

Figure 5:
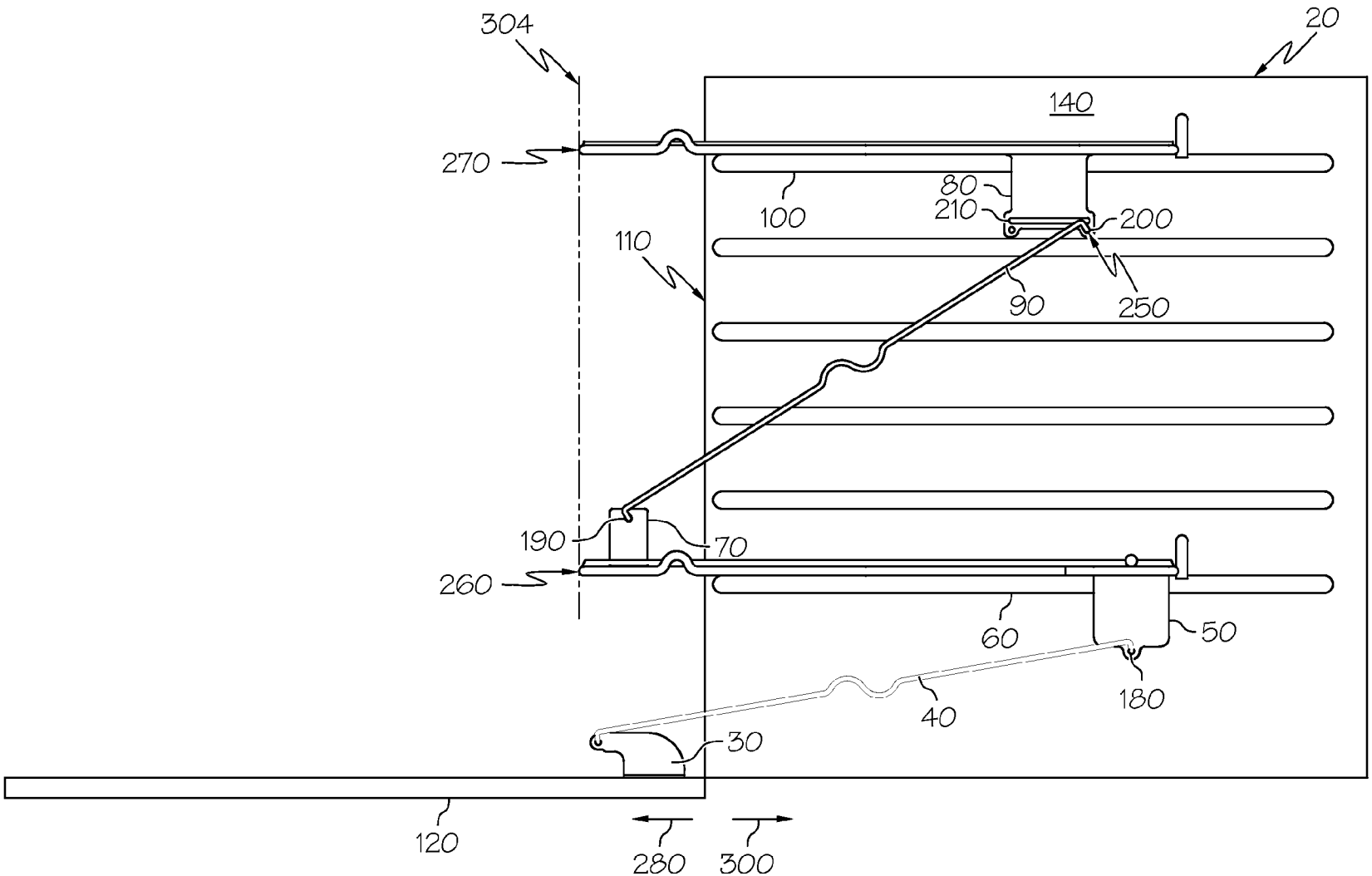
FIG. 5 illustrates a side view of the example appliance of FIG. 2 in which the racks therein are extended in a non-staggered mode.

As shown in FIG. 5, in accordance with an embodiment, the rack system 10 can be configured in a non-staggered mode. A non-staggered mode, as applied to the rack system 10, is a mode of configuration such that forward (or, conversely, backward) movement of the door link 30, as described above, results in forward (or, conversely, backward) movement of first rack 60 and second rack 100 to equal extents with regard to each other, the forward movement of first rack 60 and second rack 100 being proportional to the angular displacement of door link 30. The rack system 10 can be configured in a non-staggered mode, based on the general configuration described above, with the following additional detail that the connection of the second coupler link 90 to the bracket 80 is based on attaching, for example detachably, the second end 250 of the second coupler link 90 to the first attachment site 200 of bracket 80, for example by placing the second end 250 through the first attachment site 200 of bracket 80. In accordance with this embodiment, opening of appliance door 120 will result in forward movement of door link 30, first coupler link 40, first connector 50, first rack 60, second connector 70, second coupler link 90, bracket 80, and second rack 100, such that first rack 60 and second rack 100 move forward equal distances and such that front end 260 of first rack 60 and front end 270 of second rack 100 maintain a plane 304 that is approximately parallel to appliance front end 110 of appliance 20. Closing of appliance door 120 will likewise and accordingly result in backward movement of equal distances of first rack 60 and second rack 100.

Figure 6:
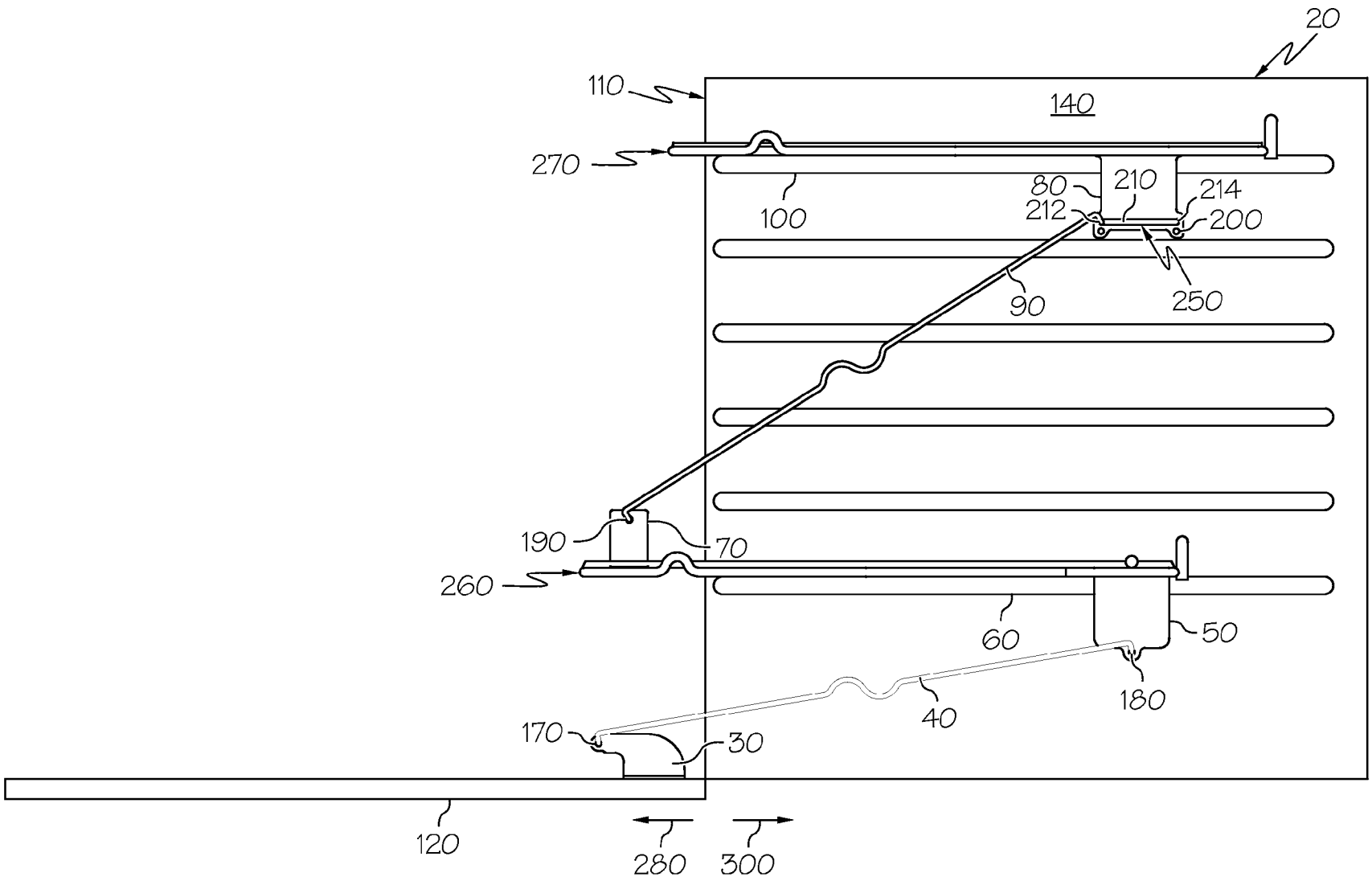
FIG. 6 illustrates a side view of the example appliance of FIG. 2 in which the racks therein are extended in a staggered mode.

As shown in FIG. 6, in accordance with another embodiment, the rack system 10 can be configured in a staggered mode. A staggered mode, as applied to the rack system 10, is a mode of configuration such that forward (or, conversely, backward) movement of the door link, as described above, results in forward (or, conversely, backward) movement of first rack 60 and potentially may also result in forward (or, conversely, backward) movement of second rack 100, the forward movement of first coupler link 40 being proportional to the angular displacement of door link 30. The rack system 10 can be configured in a staggered mode based on the general configuration described above, with the following additional detail that the connection of the second coupler link 90 to the bracket 80 is based on attaching, for example detachably, the second end 250 of the second coupler link 90 to the second attachment site 210 of bracket 80, for example by placing the second end 250 of the second coupler link 90 through the second attachment site 210 of bracket 80. In accordance with this embodiment, opening of appliance door 120 will result in forward movement of door link 30, first coupler link 40, first connector 50, first rack 60, second connector 70, and second coupler link 90, but will not result in forward movement of bracket 80 or second rack 100, unless and until second coupler link 90 moves forward a sufficient distance such that second coupler link 90 contacts front end 212 of second attachment site 210 of bracket 80. Upon making contact, and to the extent that contact is maintained, further forward movement of second coupler link 90 will result in forward movement of bracket 80 and second rack 100. In further accordance with this embodiment, closing of appliance door 120 will result in backward movement of door link 30, first coupler link 40, first connector 50, first rack 60, second connector 70, and second coupler link 90, but will not result in backward movement of bracket 80 or second rack 100, unless and until second coupler link 90 moves backward a sufficient distance such that second coupler link 90 contacts back end 214 of bracket 80 (not shown). Upon making contact, and to the extent that contact is maintained, further backward movement of second coupler link 90 will result in backward movement of bracket 80 and second rack 100 (not shown).

In further accordance with this embodiment, configuration of the rack system in a staggered mode allows for manual manipulation of the position of the second rack 100 relative to the first rack 60. Specifically, second rack 100 can be slidably extended from the appliance cavity 140 without causing extension of first rack 60 as second attachment site 210 moves relative to second coupler link 90, until second coupler link 90 comes in contact with back end 214 of second attachment site 210, from which point further manual extension of second rack 100 will cause extension of first rack 60 (not shown). Likewise, second rack 100 can be slidably retracted into the appliance cavity 140 without causing retraction of first rack 60 as second attachment site 210 moves relative to second coupler link 90, until second coupler link 90 comes in contact with front end 212 of second attachment site 210, from which point further manual retraction of second rack 100 will cause retraction of first rack 60 (not shown).

In an embodiment, the use of a door link 30, first coupler link 40, first connector 50, first rack 60, second connector 70, bracket 80, second coupler link 90, and second rack 100 that are coated, for example with high performance coatings, can facilitate slidable movement of parts relative to one another, such as relative movement of parts of round joints, relative movement of parts of elongated joints, and sliding of first rack 60 and second rack 100 relative to appliance ledges 144 while reducing wear of such parts over time.

A process for assembly of the rack system 10, for example including duplicate sets of the door link 30, first coupler link 40, second coupler link 90, brackets 80, and brackets 50 and 70, in an appliance 20, for example an oven that contains six pairs of appliance ledges 144 for support of racks, is as follows. Referring to FIG. 2, the first rack 60 is placed on one of the three pairs of appliance ledges 144 closest to an appliance bottom 320 of the appliance 20. Turning to FIG. 4, the first end 220 of first coupler link 40 is placed through attachment site 170 of the door link 30, and the second end 230 of first coupler link 40 is placed through attachment site 190 of first connector 50, thereby connecting door link 30 to first connector 50, which itself is attached to first rack 60. This process is repeated for the duplicate set of the door link 30, first coupler link 40, and first connector 50. Returning to FIG. 2, the second rack 100 is placed on one of the three pairs of appliance ledges 144 closest to an appliance top 330 of the appliance 20. Turning again to FIG. 4, the first end 240 of the second coupler link 90 is placed through attachment site 190 of second connector 70, and the second end 250 of the second coupler link 90 is placed through first attachment site 200 of bracket 80, thereby connecting second connector 70, which itself is attached to first rack 60, to bracket 80, which itself is attached to second rack 100. This process is repeated for the duplicate set of the second connector 70, second coupler link 90, and bracket 80. Attachment of the second end(s) 250 of second coupler link(s) 90 at first attachment site(s) 200 of bracket(s) 80 results in the non-staggered mode for the rack system 10. In another embodiment, placement of the second end 250 of the second coupler link 90, not through first attachment site 200 of bracket 80 but rather through second attachment site 210 of bracket 80, and optionally repeating the process for a duplicate set of the second connector 70, second coupler link 90, and bracket 80, results in the staggered mode for the rack system 10.

Figure 7:
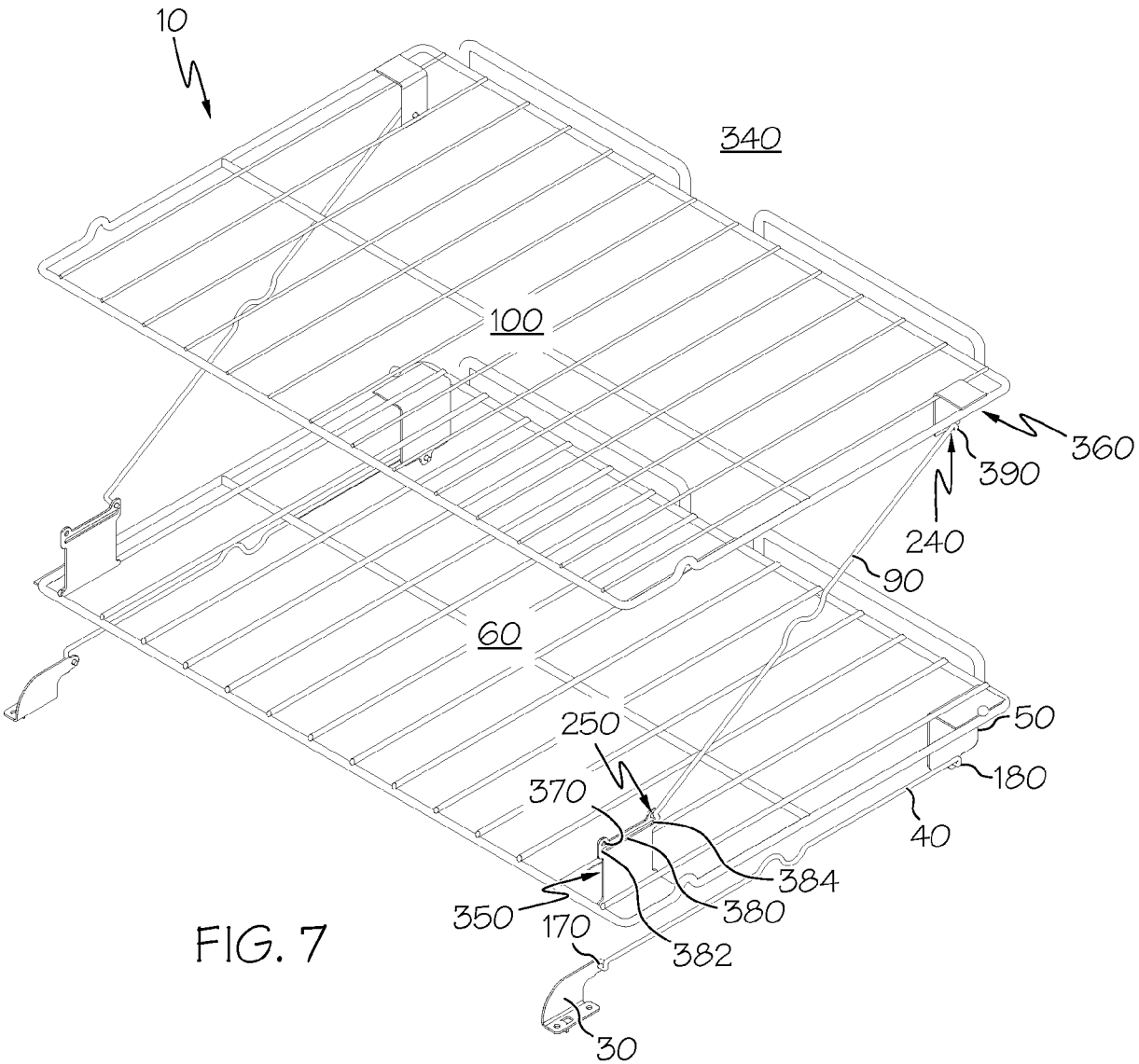
FIG. 7 illustrates a perspective view of another example rack system in accordance with another embodiment of the present invention.

Turning to the FIG. 7, an example of an alternative configuration 340 for the rack system 10 is shown in accordance with another embodiment. The alternative configuration 340 includes a bracket 350 and a connector 360, in place of second connector 70 and bracket 80, respectively, and otherwise includes the various other parts of rack system 10 as described above. Bracket 350 includes first attachment site 370, corresponding for example to a round aperture, and second attachment site 380, corresponding for example to an elongated aperture. The second attachment site 380 has a front end 382 and a back end 384, the front end 382 and back end 384 being located proximal and distal, respectively, to appliance front end 110. When first rack 60 and second rack 100 are entirely contained within appliance 20, back end 384 is further from appliance front end 110 than is any part of first attachment site 370. Connector 360 includes an attachment site 390, corresponding for example to a round aperture. The bracket 350 is attached to first rack 60. Connector 360 is attached to second rack 100.

In accordance with this embodiment, the rack system 10 can translationally couple the appliance door 120 to the first rack 60 and the second rack 100, based on the various attachments and connections described above, with the exception that the first rack 60 is connected to the second rack 100 not via second connector 70, second coupler link 90, and bracket 80, but rather through bracket 350, second coupler link 90, and connector 360. More particularly, the second end 250 of second coupler link 90 can be attached at first attachment site 370 of bracket 350, and the first end 240 of second coupler link 90 can be attached at attachment site 390 of connector 360, resulting in a non-staggered mode. In an alternative embodiment, the second end 250 of second coupler link 90 can be attached at second attachment site 380 of bracket 350, and the first end 240 of second coupler link 90 can be attached at attachment site 390 of connector 360, resulting in a staggered mode.

A process for assembly of this embodiment, for example including duplicate sets of the door link 30, first coupler link 40, first connector 50, bracket 350, second coupler link 90, and connector 360, can be accomplished by the process described above, with the exception that the step of connecting second connector 70, second coupler link 90, and bracket 80 is replaced by a step of connecting bracket 350, second coupler link 90, and connector 360.

It is to be appreciated that the rack system can be used with supports other than, or in addition to, appliance ledges. For example, appliance glides, corresponding to supports that can be extended from or retracted into an appliance cavity based on rollers, can be used for support of racks of the rack system.

It is also to be appreciated the rack system can be positioned at and supported by various appliance supports, such as ledges or glides, within an appliance. For example, in an oven including six pairs of ledges or glides and an oven door that is attached to the oven based on hinges at the front of the bottom of the oven, the first rack of the rack system can be used on any of the lowest three pairs of ledges or glides, and the second rack can be spaced two or three ledges or glides above the first rack. The result is that all ledge or glide positions can be given full functionality with regard to the rack system.

It is also to be appreciated that detachable attachment of various components of the rack system, based for example on quick connect coupler links, allows for assembly and disassembly of a rack system in place, for example within an appliance, manually, and without requiring use of a tool. This detachability allows, for example, removal of the various components of a rack system from an oven for cleaning the components, for example in a sink, and to prevent damage to the components during self-cleaning of an oven, for example based on high levels of heat associated with self-cleaning. Moreover, support of the racks by appliance ledges or glides precludes a need for any additional framing or support structure.

It is also to be appreciated that the rack system can be modified such that the first coupler link is attached directly to the first rack, for example based on an aperture, slot, groove, or the like present in the first rack, rather than being connected to the first rack via a bracket, eliminating the need for the bracket in this context (not shown). Likewise, the rack system can be modified such that the second coupler link is attached directly to whichever of the first or second rack to which the bracket is not attached, again based on an aperture, slot, groove, or the like present in the rack, rather than being connected to the rack via a bracket, eliminating the need for another bracket (not shown).

It is also to be appreciated that the rack system can be modified based on including at least in duplicate various parts, for example the door link, first coupler link, second coupler link, and bracket. By including the various parts at least in duplicate, a set of each of the door link, first coupler link, second coupler link, and bracket can be present adjacent and in close proximity to each of the appliance side walls, for example within 0.1 to 5 inches, 0.3 to 3 inches, or 0.5 to 1 inches.

It is also to be appreciated that an appliance including the rack system can be modified to include racks in addition to the first rack and the second rack of the rack system. For example, in an oven that includes six pairs of appliance ledges or glides and that thus can include up to six racks, one or more racks can be added in addition to the first rack and the second rack of the rack system. Moreover, the second rack of the rack system can be readily disconnected from the rack system, for example by detaching the connection between the second coupler link and first rack or second rack. In addition, one or more additional racks can be connected to rack system, for example by connecting to the second rack an additional bracket, coupler link, bracket, and rack.

It is also to be appreciated that the rack system, in its various embodiments, can be used in settings other than in an oven. For example, the rack system can be used in a refrigerator and/or freezer unit. Further, it is to be appreciated that the rack system can be constructed of any suitable material, such as metal, plastic, and the like. Further still, the various parts of the rack system need not all be constructed from the same materials.

The overall size of the rack system and the sizes of the various parts thereof also depend upon the intended use of the rack. In the example embodiments, the rack system and the various parts thereof are designed to be connected, attached, and used in a conventional oven. The rack system can be made larger to fit commercial ovens or sized to fit any other appliance or other apparatus in which the rack system is to be used.

The invention has been described with reference to various example embodiments. Obviously, modifications and alterations will occur to others upon a reading and understanding of this specification. It is intended to include all such modifications and alterations insofar as they come within the scope of the appended claims or the equivalents thereof.

What is claimed is:

1. A rack system for an appliance, comprising:

an appliance having a cavity and a door operable to close the cavity;

a first rack and a second rack positioned within the cavity;

a door link coupled to the appliance door;

a first connector attached to the first rack;

a second connector attached to the first rack;

a first coupler link having a first end and a second end, the first end being detachably attached to the door link and the second end being detachably attached to the first connector;

a second coupler link having a first end and a second end, the first end being detachably attached to the second connector and the second end being detachably attached to the second rack; and a bracket having a first attachment site and a second attachment site, wherein the second coupler link is coupled to the bracket via one of the first and second attachment sites, wherein the bracket is detachably connected to the second rack wherein the first attachment site is a round aperture, and wherein the second attachment site is an elongated aperture and configured such that when the first rack is at least partially extended from the appliance cavity and is extended to a greater extent than the second rack, the second rack can be manually further slidably extended from the appliance cavity.

2. The appliance rack system of claim 1, wherein the bracket is attached to the second rack.

3. The appliance rack system of claim 2, wherein the second coupler link is detachably attached at the round aperture, thereby forming a rotating joint, the rack system being configured for slidably extending and retracting the first and second racks from and into an appliance cavity in a non-staggered mode.

4. The appliance rack system of claim 2, wherein the second coupler link is detachably attached at the elongated aperture, thereby forming a sliding joint, the rack system being adapted for slidably extending and retracting the first and second racks from and into an appliance cavity in a staggered mode.

5. The appliance rack system of claim 4, the elongated aperture being adapted such that, when the first rack is at least partially extended from the appliance cavity and is extended to a greater extent than the second rack, the second rack can be manually further slidably extended from the appliance cavity.

6. The appliance rack system of claim 1, wherein the door link, the first coupler link, the second coupler link, and the bracket are present at least in duplicate.

7. The appliance rack system of claim 1, wherein the appliance door comprises an appliance door surface that faces inward toward the appliance cavity, the door link being located on the appliance door surface.

8. The appliance rack system of claim 1, further comprising:

a second bracket, the second bracket being attached to whichever of either the first rack or the second rack to which the bracket is not attached, the second coupler link being connected, via attachment to the second bracket, to whichever of either the first rack or the second rack to which the bracket is not attached.

9. An appliance comprising:

an appliance cavity, a plurality of appliance supports, an appliance door, a first rack, a second rack, a bracket, a door link, a first coupler link, and a second coupler link;

the bracket having a plurality of apertures for attachment with the second coupler link;

the plurality of appliance supports being located within the appliance cavity;

the first rack being supported by at least one of the appliance supports for slidably extending from and retracting into the appliance cavity;

the second rack being supported by at least another of the appliance supports for slidably extending from and retracting into the appliance cavity;

the door link being attached to the appliance door;

the first coupler link being attached to the door link and connected to the first rack;

the bracket being a plate-like structure that is detachably connected to either the first rack or the second rack;

the second coupler link being attached to the bracket at one of the apertures for attachment of the bracket and connected to whichever one of either the first or second racks to which the bracket is not attached;

the first rack being translationally coupled to the appliance door through the door link and the first coupler link and not through the bracket or the second coupler link;

and the second rack being translationally coupled to the first rack through the bracket and the second coupler link and not through the door link or the first coupler link wherein the second coupler link is connected to the second rack at a position below a cooking surface of the second rack.

10. The appliance of claim 9, wherein the plurality of apertures comprises a round aperture and an elongated aperture, the second coupler link being attached at one of the round aperture or the elongated aperture.

11. The appliance of claim 10, wherein the bracket is attached to the second rack.

12. The appliance of claim 11, wherein the second coupler link is detachably attached at the round aperture, thereby forming a rotating joint, the appliance being adapted for slidably extending and retracting the first and second racks from and into an appliance cavity in a non-staggered mode.

13. The appliance of claim 11, wherein the second coupler link is detachably attached at the elongated aperture, thereby forming a sliding joint, the appliance being adapted for slidably extending and retracting the first and second racks from and into an appliance cavity in a staggered mode.

14. The appliance of claim 10, further comprising a first side wall and a second side wall, the first and second side walls opposing each other and facing the appliance cavity, the first and second side walls comprising a plurality of ledges adapted to slidably support the first and second racks.

15. The appliance of claim 14, wherein the door link, the first coupler link, the second coupler link, and the bracket are present at least in duplicate and are positioned such that, when the appliance door is in a closed position, at least one door link, first coupler link, second coupler link, and bracket are located adjacent and in close proximity to the first side wall and at least one door link, first coupler link, second coupler link, and bracket are located adjacent and in close proximity to the second side wall.

16. The appliance of claim 10, further comprising:

a first bracket and a second bracket;

the first bracket being attached to the first rack, the first coupler link being connected to the first rack via attachment to the first bracket;

and the second bracket being attached to whichever of either the first rack or the second rack to which the bracket is not attached, the second coupler link being connected, via attachment to the second bracket, to whichever of either the first rack or the second rack to which the bracket is not attached.

17. The appliance of claim 10, wherein the appliance is an oven.

18. A rack system for an appliance, comprising:

an appliance having a cavity and a door operable to close the cavity;

a first rack and a second rack positioned within the cavity;

a door link coupled to the appliance door;

a first coupler link detachably coupled to the door link and the first rack;

a second coupler link detachably coupled between the first rack and the second rack; and a bracket having a first attachment site and a second attachment site, wherein the second coupler link is coupled to the bracket via one of the first and second attachment sites, wherein the bracket is detachably connected to one of the first and second racks wherein the first attachment site is a round aperture, and wherein the second attachment site is an elongated aperture and configured such that when the first rack is at least partially extended from the appliance cavity and is extended to a greater extent than the second rack, the second rack can be manually further slidably extended from the appliance cavity.

* * * * *